US008109740B2

(12) United States Patent
Kang et al.

(10) Patent No.: US 8,109,740 B2
(45) Date of Patent: Feb. 7, 2012

(54) MOUNTING STRUCTURE OF LINEAR COMPRESSOR

(75) Inventors: Kyoung-Seok Kang, Changwon-si (KR); Yangjun Kang, Changwon-si (KR); Min-Woo Lee, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 624 days.

(21) Appl. No.: 12/087,777

(22) PCT Filed: Jan. 16, 2007

(86) PCT No.: PCT/KR2007/000267

§ 371 (c)(1),
(2), (4) Date: Mar. 24, 2009

(87) PCT Pub. No.: WO2007/081191

PCT Pub. Date: Jul. 19, 2007

(65) Prior Publication Data

US 2010/0034676 A1 Feb. 11, 2010

(30) Foreign Application Priority Data

Jan. 16, 2006 (KR) ..... 10-2006-0004639

(51) Int. Cl.

| | |
|---|---|
| ***F04B 35/04*** | (2006.01) |
| ***F04B 17/03*** | (2006.01) |
| ***H02K 33/00*** | (2006.01) |
| ***H02K 35/00*** | (2006.01) |

(52) U.S. Cl. ..... 417/417; 417/416; 417/415; 310/15; 310/17

(58) Field of Classification Search ..... 417/415–419; 310/15–24

See application file for complete search history.

(56) References Cited

U.S. PATENT DOCUMENTS

| | | | | |
|---|---|---|---|---|
| 3,788,788 | A | 1/1974 | Hehl | |
| 3,947,155 | A * | 3/1976 | Bidol | 417/417 |
| 6,755,627 | B2 | 6/2004 | Chang | |
| 7,264,451 | B2 * | 9/2007 | Park | 417/417 |
| 2001/0043870 | A1 | 11/2001 | Song | |
| 2002/0122732 | A1 * | 9/2002 | Oh et al. | 417/417 |
| 2003/0175135 | A1 * | 9/2003 | Heo et al. | 417/416 |

FOREIGN PATENT DOCUMENTS

| | | |
|---|---|---|
| CN | 1380946 | 11/2002 |
| JP | 2003-166468 | 6/2003 |
| JP | 2004-116513 | 4/2004 |
| JP | 2004-346699 | 12/2004 |
| WO | WO 02/095232 | 11/2002 |

* cited by examiner

*Primary Examiner* — Mariceli Santiago

(74) *Attorney, Agent, or Firm* — McKenna Long & Aldridge LLP

(57) ABSTRACT

The present invention discloses a mounting structure of a linear compressor, comprising: a shell which is a hermetic space, a connection terminal for supplying power being fixed to one side of the shell; a main body frame installed in the shell, one end of a cylinder forming a compression space for compressing a refrigerant with a piston being fixed to the main body frame; and a motor cover, a linear motor comprised of an inner stator, an outer stator and a mover, for reciprocating the piston by a mutual electromagnetic force being fixed to the outer circumference of the cylinder, the outer stator being bolt-fastened between the main body frame and the motor cover. Here, the main body frame is left-right symmetric.

8 Claims, 4 Drawing Sheets

[Fig. 1]
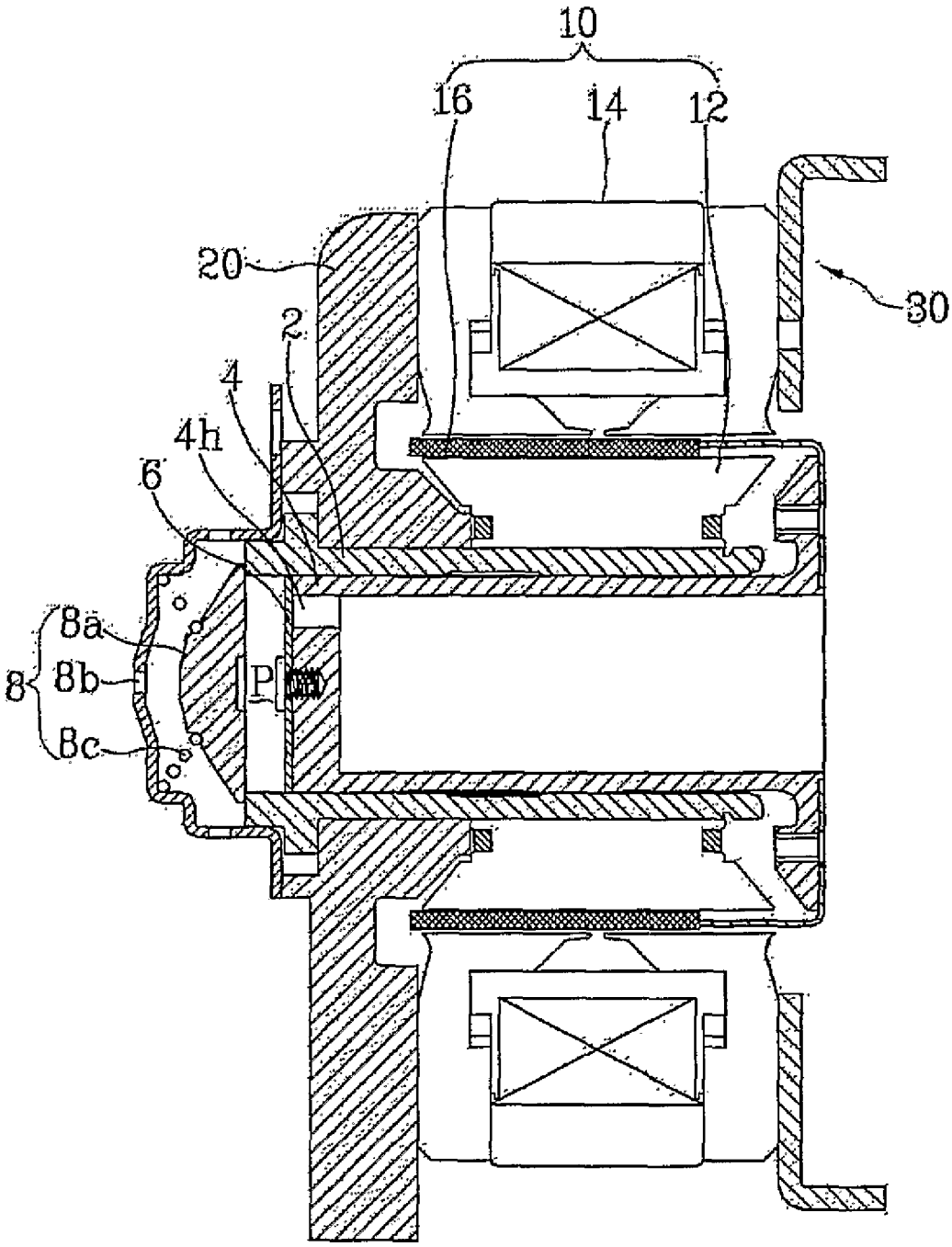

[Fig. 2]
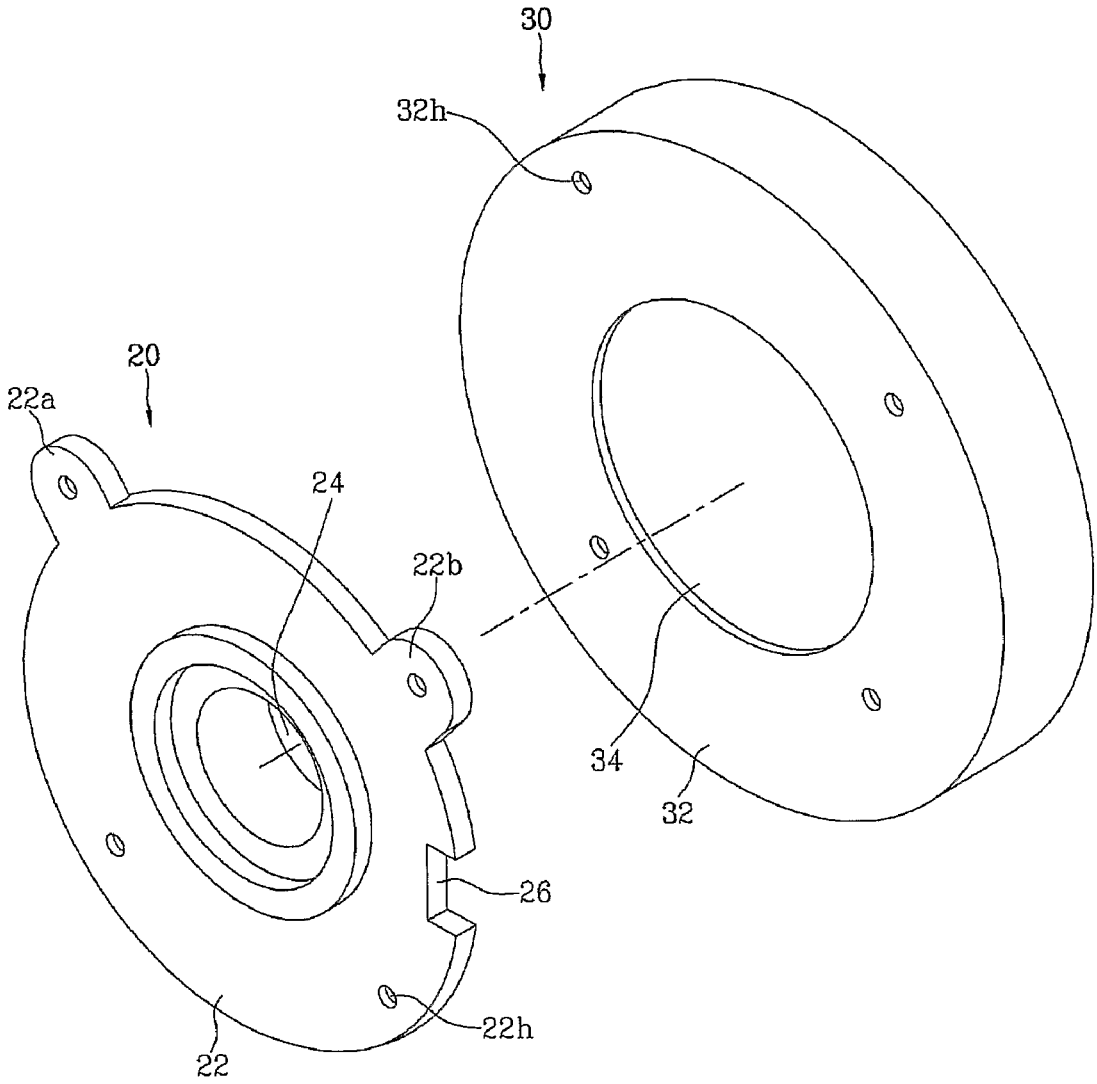

[Fig. 3]
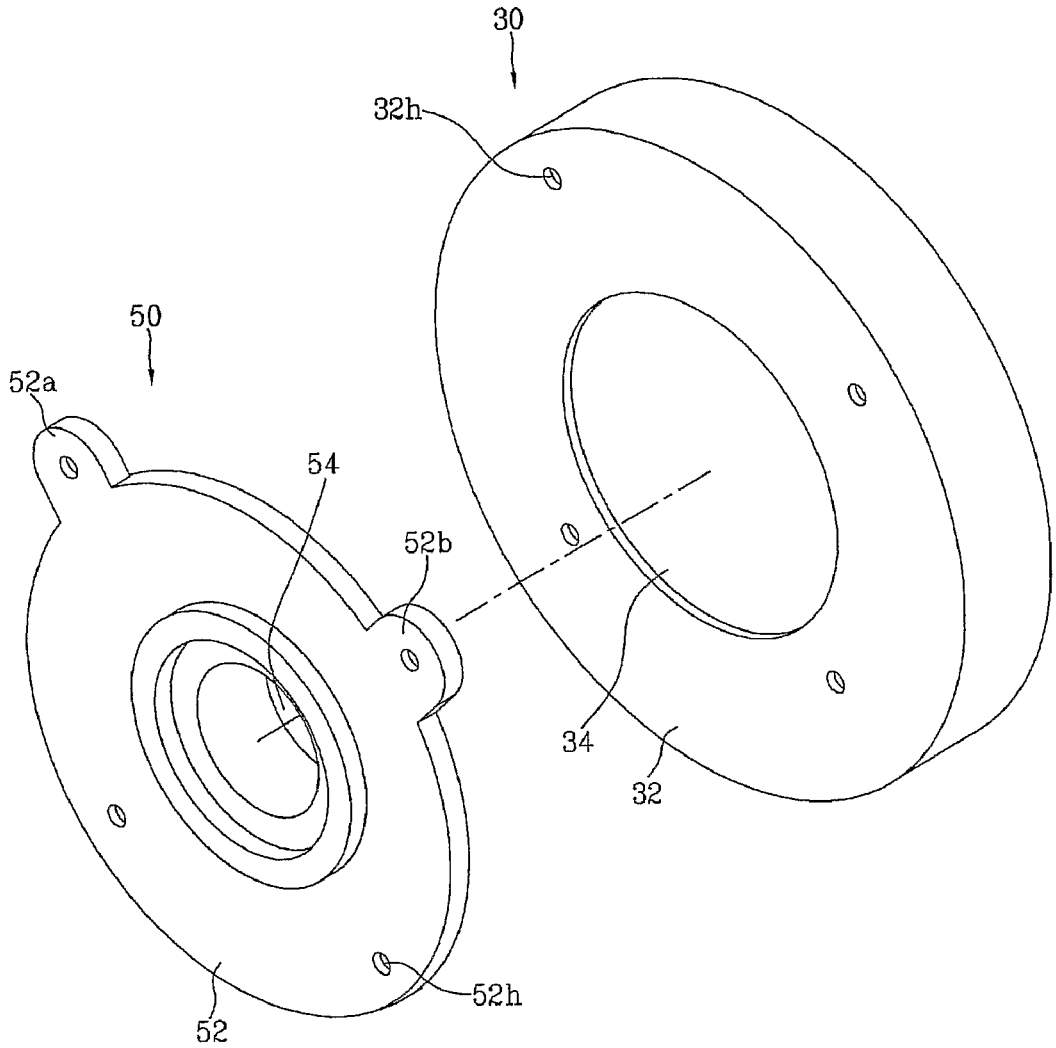

[Fig. 4]
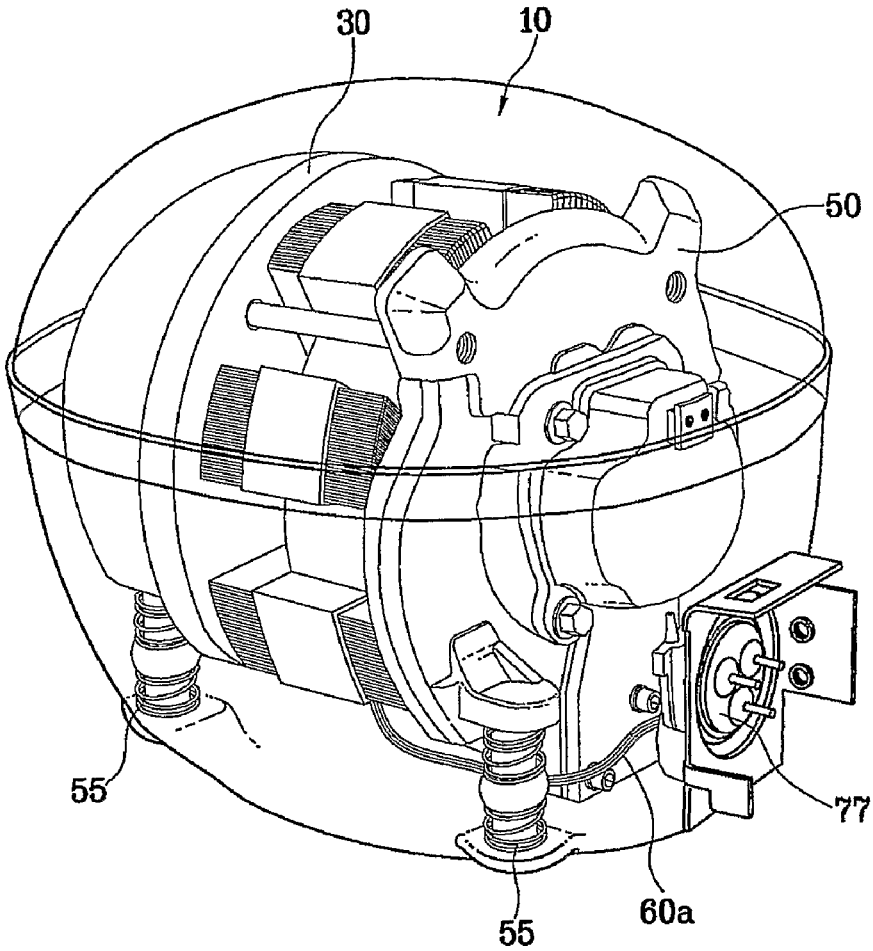
[Fig. 5]
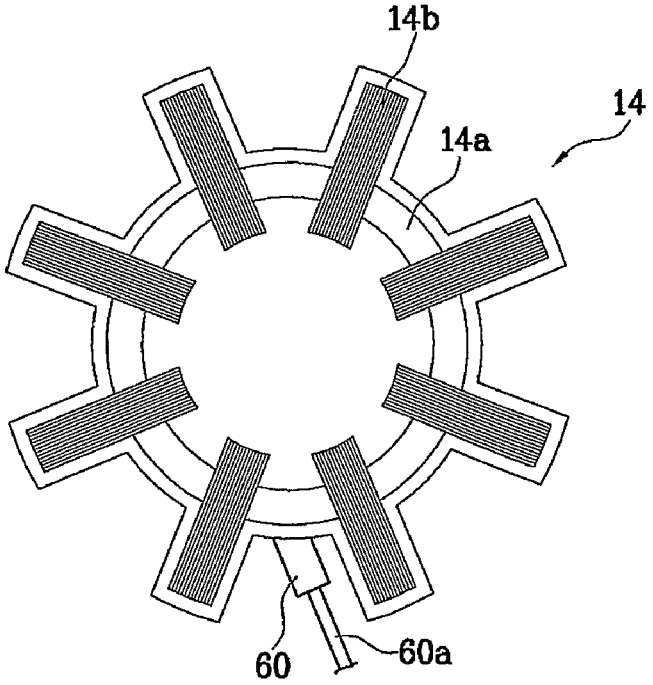

MOUNTING STRUCTURE OF LINEAR COMPRESSOR

This application claims priority to international application No. PCT/KR2007/000267 filed on Jan. 16, 2007 which claims priority to Korean Application No. 10-2006-0004639 filed Jan. 16, 2006, both of which are incorporated by reference, as if fully set forth herein.

TECHNICAL FIELD

The present invention relates to a mounting structure of a linear compressor in which a cylinder, a piston and a linear motor are installed between a frame and a motor cover, and more particularly, to a mounting structure of a linear compressor which can allow a motor terminal for supplying power to a linear motor to be taken out without interference with the other components, reduce assembly deformation by forming a frame and a motor cover in a symmetric shape, and stably support the linear motor.

BACKGROUND ART

FIG. 1 is a side-sectional view illustrating a part of a usual linear compressor, and FIG. 2 is a disassembled perspective view illustrating a frame and a motor cover of the conventional linear compressor.

Referring to FIG. 1, in the usual linear compressor, one end of a piston 4 is inserted into a cylinder 2, for forming a compression space P, and a linear motor 10 including an inner stator 12, an outer stator 14 and a permanent magnet 16 linearly reciprocates the piston 4 by a mutual electromagnetic force, thereby a refrigerant is sucked into the compression space P, and compressed and discharged.

The structure comprising the cylinder 2, the piston 4 and the linear motor 10 is installed in a shell (not shown) which is a hermetic space, and elastically supported by buffering springs (not shown). A suction valve 6 is installed on a suction hole 4*h* formed at one end of the piston 4 to communicate with the compression space P. A discharge valve assembly 8 in which a discharge valve 8*a* is elastically supported by a discharge valve spring 8*c* inside a discharge cap 8*b* to be opened and closed is installed at one end of the cylinder 2. Accordingly, suction and discharge of the refrigerant are controlled according to a pressure inside the compression space P.

One end of the cylinder 2 is fixed to the frame 20. The inner stator 12 is fixedly installed on the outer circumference of the cylinder 2. The outer stator 14 is bolt-fastened between the frame 20 and the motor cover 30 with an interval from the outer circumference of the inner stator 12. The permanent magnet 16 is installed between the inner stator 12 and the outer stator 14 with an interval, and connected to the other end of the piston 4.

A supporter (not shown) connected to the other end of the piston 4 is elastically supported in the notion direction by a plurality of springs (not shown) between the motor cover 30 and a main body cover (not shown) installed with an interval from the motor cover 30 in the motion direction.

Accordingly, the cylinder 2, the inner stator 12, the outer stator 14, the frame 20, the motor cover 30 and the main body cover are fixed, and the piston 4, the permanent magnet 16 and the supporter are linearly reciprocated. As the pressure inside the compression space P is varied, the refrigerant is sucked into the compression space P, compressed, and discharged.

As shown in FIG. 2, the frame 20 is formed in a flat plate shape. A cylinder mounting hole 24 through which the cylinder 2 is installed is formed at the frame 20. A motor terminal taking out hole 26 is formed at one side of the frame 20, so that a motor terminal (not shown) connected to a coil winding body (not shown) of the outer stator 14 can be taken out through the motor terminal taking out hole 26.

Since an interval between the frame 20 and the shell (not shown) is small, the motor terminal taking out hole 26 is formed on the side surface of the frame 20 to take out the motor terminal. Therefore, even if vibration is generated, this configuration prevents an electric wire connected to the motor terminal frame being damaged in contact with the shell (not shown) and the frame 20.

The portion around the motor terminal taking out hole 26 of the frame 20 is formed thick for stably supporting the outer stator 14, even though the motor terminal taking out hole 26 is formed at one side of the frame 20.

Except the surface 22 of the frame 20 for supporting the outer stator 14, an unnecessary portion of the frame 20 is removed to reduce the whole volume of the frame 20. In addition, four bolt holes 22*h* are formed on the frame 20 so that the motor cover 30 can be bolt-fastened to the frame 20. Accordingly, protruding units 22*a* and 22*b* are protruded from the frame 20 to secure spaces for forming the bolt holes 22*h*.

Meanwhile, the motor cover 30 is formed in a metal plate shape. One surface 32 of the motor cover 30 supports the outer stator 14. Bolt holes 32*h* are formed on the motor cover 30 to correspond to the bolt holes 22*h* of the frame 20, so that the motor cover 30 can be bolt-fastened to the frame 20.

Preferably, a through hole 34 is formed at the center portion of the motor cover 30, so that the other end of the piston 4 can pass through the through hole 34 for linear reciprocation.

The frame 20 and the motor cover 30 are positioned on the same axle. The motor cover 30 is bolt-fastened to the frame 20 in the motion direction of the piston 4, for supporting and fixing the outer stator 14. The motor terminal is taken out through the motor terminal taking out hole 26 of the frame 20, and connected to a power supply source.

However, in the conventional mounting structure of the linear compressor, since the motor terminal taking out hole 26 is formed at one side of the frame 20 to take out the motor terminal, the frame 20 is not completely symmetric. When the motor cover 30 is bolt-fastened to the frame 20, twist deformation may occur due to the fastening force. Accordingly, the cylinder 2 installed between the frame 20 and the motor cover 30 may be deformed to cause an assembly error and an operation error. Furthermore, when the motor terminal taking out hole 26 is formed at the frame 20, the hole-formed portion of the frame 20 must be formed relatively thick to stably support the outer stator 16. As a result, the manufacturing process is complicated and the material cost is increased.

DISCLOSURE OF INVENTION

Technical Problem

An object of the present invention is to provide a mounting structure of a linear compressor which can allow take out a motor terminal to be taken out for supplying power to a linear motor without interference with the other components, prevent assembly deformation by forming a frame and a motor cover in a symmetric shape, and stably support the linear motor.

Technical Solution

There is provided a mounting structure of a linear compressor comprising: a cylinder for providing a space for compressing a refrigerant; a piston reciprocated inside the cylinder, for compressing the refrigerant; a linear motor including a motor cover and operating the piston; and a frame to which one end of the cylinder is fixed and the motor cover is bolt-fastened, the frame being left-right symmetric or up-down symmetric. By this configuration, the fastening force is uniformly distributed on the frame, thereby minimizing twisting of the frame in assembly.

In another aspect of the present compressor, the frame and the motor cover include corresponding bolt holes, and the bolt holes are up-down symmetric and left-right symmetric. By this configuration, when the frame and the motor cover are fastened by the bolts passing through the bolt holes, respectively, the fastening force is evenly dispersed on the frame and the motor cover, thereby minimizing twisting of the frame and the motor cover.

In another aspect of the present invention, the motor cover is up-down symmetric and left-right symmetric.

In another aspect of the present invention, the mounting structure of the linear compressor includes a motor terminal taken out through the lower portions of the motor cover and the frame. By this configuration, the motor terminal taking out hole is not formed on the motor cover, thereby evenly dispersing the force applied to the motor cover. In addition, this configuration can omit a complicated process of increasing the thickness of the peripheral region of the motor terminal taking out hole to offset reduction of the strength in the region.

In another aspect of the present invention, the motor cover includes a pair of protrusion units which are left-right symmetric, and bolt holes for bolt-fastening the rotor cover to the frame are formed on the protrusion units. By this configuration, the spaces for forming the bolt holes can be prepared without increasing the size of the motor cover.

In another aspect of the present invention, the motor cover is formed in any one of a circular shape and an elliptical shape. By this configuration, the bolt fastening force can be uniformly distributed on the whole surface of the motor cover.

In another aspect of the present invention, the linear motor includes an inner stator, an outer stator and a permanent magnet, and the outer stator includes a coil winding body and a plurality of core blocks. And the mounting structure of the linear compressor further includes a motor terminal installed in the space between the core blocks.

In another aspect of the present invention, the rotor terminal is connected to the coil winding body between the core blocks, and inclined at an angle to a normal line direction of the coil winding body in the connection point. By this configuration, an electric wire connected to the rotor terminal can be taken out through the side surface of the lower structure of the frame without interfering with the lower structure of the frame.

In another aspect of the present invention, the length from the coil winding body to the end of the motor terminal is shorter than the length from the coil winding body to the ends of the core blocks. This configuration serves to prevent an impact applied from a shell to the motor terminal.

In another aspect of the present invention, the mounting structure of the linear compressor further comprises a shell; support springs for supporting a main body frame inside the shell; a terminal for supplying power to the linear compressor; and an electric wire for connecting the rotor terminal to the terminal. The end of the rotor terminal is placed at a distance from the bottom of the shell, and the electric wire is taken out between the support springs and connected to the terminal. By this configuration, the electric wire can be connected to the terminal without interfering with the other structures of the linear compressor.

Advantageous Effects

In accordance with the present invention, in the mounting structure of the linear compressor, the frame is formed in a closed loop shape to be left-right symmetric with the motor cover, and the motor terminal for supplying power to the linear motor is taken out through the relatively large space under the frame without interfering with the other peripheral components. In a state where the cylinder, the piston and the linear motor are mounted between the frame and the rotor, even though the frame and the motor cover are bolt-fastened to each other, deformation by the fastening force is prevented to improve assembly efficiency and operation reliability. As the frame is formed in the closed loop shape, it can stably support the linear motor. Furthermore, the whole manufacturing process can be simplified by emitting the motor terminal taking out hole.

BRIEF DESCRIPTION OF THE DRAWINGS

FIG. 1 is a side-sectional view illustrating a part of a conventional linear compressor;

FIG. 2 is a disassembled perspective view illustrating a frame and a motor cover of the conventional linear compressor;

FIG. 3 is a disassembled perspective view illustrating a frame and a motor cover of a linear compressor in accordance with the present invention;

FIG. 4 is a perspective view illustrating a state in which a motor terminal is taken out of the linear compressor in accordance with the present invention; and FIG. 5 is a structure view illustrating a state in which the motor terminal is connected to a linear motor of the linear compressor in accordance with the present invention.

MODE FOR THE INVENTION

The present invention will now be described in detail with reference to the accompanying drawings.

FIG. 3 is a disassembled perspective view illustrating a frame and a motor cover of the linear compressor in accordance with the present invention, FIG. 4 is a perspective view illustrating the linear compressor in accordance with the present invention, and FIG. 5 is a structure view illustrating an outer stator of a linear motor in accordance with the present invention. In the following description, the same reference numerals are used for the same elements as those of FIG. 1. Since a cylinder 2, a piston 4, a linear motor 10 and a motor cover 30 are identical to the conventional ones, detailed explanations thereof are omitted. As illustrated in FIGS. 3 to 5, in the mounting structure of the linear compressor, the cylinder 2, the piston 4 and the linear motor 10 are fixedly installed between the frame 50 and the motor cover 30 which are left-right symmetric. The linear motor 10 includes an inner stator 12, an outer stator 14 and a permanent magnet 16. The outer stator 14 includes a coil winding body 14*a* and core blocks 14*b*. Power is supplied to the coil winding body 14*a* through a motor terminal 60 connected to the coil winding body 14*a*, so that the coil winding body 14*a* can generate a mutual electromagnetic force. An electric wire 60*a* of the motor terminal 60 is taken out through a space under the frame 50, and connected to a terminal 77 installed on a shell 51. Therefore, the electric wire 60*a* does not interfere with the adjacent components.

The frame 50 forms a kind of closed loop. The outer stator 14 is stably supported in the axial direction on one surface 52 of the frame 50. A cylinder mounting hole 54 is formed at the center portion of the frame 50, so that the cylinder 2 can pass through the cylinder mounting hole 54.

Four bolt holes 52*h* for bolt-fastening the motor cover 30 to the frame 50 are formed at the frame 50 to be up-down symmetric and left-right symmetric. The smaller the volume of the frame 50 is, the more an eddy current loss is reduced. As the frame 50 is smaller than the motor cover 30, it may not have sufficient spaces for forming the bolt holes 52*h*. In order to obtain the spaces for forming the bolt holes 52*h*, a pair of protrusion units 52*a* and 52*b* are formed on the frame 50 to be left-right symmetric.

One end of the cylinder 2 is inserted into the cylinder mounting hole 54 of the frame 50. A discharge valve assembly 8 is mounted on one end of the cylinder 2. The inner stator 12 is fixed to the outer circumference of the cylinder 2, and the outer stator 14 is fixed to the inner stator with a interval in the radial direction. In a state where one end of the outer stator 14 is supported by the frame 50 and the other end thereof is supported by the motor cover 30, the motor cover 30 is bolt-fastened to the frame 50.

A suction valve 6 is mounted on one end of the piston 4, and the permanent magnet 16 is connected to the other end of the piston 4. One end of the piston 4 is inserted into the cylinder 2, for forming a compression space P in the cylinder 2. The permanent magnet 16 is installed between the inner stator 12 and the outer stator 14 with a gap.

The structure comprising the cylinder 2, the piston 4, the linear motor 10, the frame 50 and the motor cover 30 is supported by buffering springs 55 in the shell 51 and installed on the bottom surface of the shell 51.

The terminal 77 is installed at the shell 51, for supplying external power to the linear motor 10 of the linear compressor. Normally, the terminal 77 includes pins. The electric wire 60*a* is connected between the linear motor 10 and the terminal 77, for supplying power to the linear motor 10.

The outer stator 14 includes the coil winding body 14*a* formed by winding a coil in the circumferential direction, and the pair of core blocks 14*b* formed by laminating a plurality of laminations, and disposed on the coil winding body 14*a* at intervals in the circumferential direction. The piston 4 is driven by the mutual electromagnetic force induced by the coil winding body 14*a*. It is thus necessary to install the motor terminal 60 for supplying power to the coil winding body 14*a*. In addition, the motor terminal 60 is connected to the terminal 77 through the electric wire 60*a*, for supplying power to the outer stator 14.

When the motor terminal 60 is connected to the coil winding body 14*a* of the outer stator 14, the motor terminal 60 is inclined at an angle to a normal line direction of the coil winding body 14*a* in the connection point. Accordingly, the electric wire 60*a* is not interfered by the structure disposed at the bottom end of the frame 50. On the other hand, the motor terminal 60 is disposed between the core blocks 14*b* of the outer stator 14. Preferably, the angle of the motor terminal 60 is determined so that the electric wire 60*a* does not contact one side of the core blocks 14*b*.

The electric wire 60*a* of the motor terminal 60 taken out through the space under the frame 50 is connected to the terminal 77 fixed to the inner wall of the shell 51. The terminal 77 is connected to a control box (not shown), for controlling power supply.

As discussed earlier, in accordance with the present invention, the hole for taking out the motor terminal 60 is not formed on the frame 50, so that the frame 50 can form a relatively narrow closed loop which is left-right symmetric. As a result, when the motor cover 30 is bolt-fastened to the frame 50 to generate the fastening force, even though the frame 50 is thin, the left-right symmetry of the frame 50 serves to reduce fastening deformation and stably support the outer stator 14.

Although the preferred embodiments of the present invention have been described, it is understood that the present invention should not be limited to these preferred embodiments but various changes and modifications can be made by one skilled in the art within the spirit and scope of the present invention as hereinafter claimed.

The invention claimed is:

1. A mounting structure of a linear compressor, comprising:

a cylinder for providing a space for compressing a refrigerant;

a piston reciprocated inside the cylinder, for compressing the refrigerant;

a linear motor including an inner stator fixedly installed on the outer circumference of the cylinder, an outer stator including a coil winding body and a plurality of core blocks so as to maintain an interval from the outer circumference of the inner stator and a permanent magnet installed between the inner stator and outer stator with an interval and connected to the piston for operating the piston;

a frame to which one end of the cylinder is fixed, the frame being left-right symmetric or up-down symmetric, and a motor cover being up-down symmetric and left-right symmetric, wherein the outer stator is bolt fastened between the frame and the motor cover.

2. The mounting structure of claim 1, wherein the frame and the motor cover include corresponding bolt holes, and the bolt holes are up-down symmetric and left-right symmetric.

3. A mounting structure of a linear compressor, comprising:

a cylinder for providing a space for compressing a refrigerant;

a piston reciprocated inside the cylinder, for compressing the refrigerant;

a linear motor including a motor cover and operating the piston;

a frame to which one end of the cylinder is fixed and the motor cover is bolt-fastened, the frame being left-right symmetric or up-down symmetric; and a motor terminal taken out through a space under the motor cover and the frame.

4. The mounting structure of claim 1, wherein the motor cover is formed in any one of a circular shape and an elliptical shape.

5. A mounting structure of a linear compressor, comprising:

a cylinder for providing a space for compressing a refrigerant;

a piston reciprocated inside the cylinder, for compressing the refrigerant;

a linear motor including a motor cover and operating the piston, wherein the linear motor comprises an inner stator, an outer stator and a permanent magnet, and the outer stator comprises a coil winding body and a plurality of core blocks;

a frame to which one end of the cylinder is fixed and the motor cover is bolt-fastened, the frame being left-right symmetric or up-down symmetric; and a motor terminal installed in the space between the core blocks.

6. The mounting structure of claim 5, wherein the motor terminal is connected to the coil winding body between the core blocks, and inclined at an angle to a normal line direction of the coil winding body in the connection point.

7. The mounting structure of claim 5, wherein the length from the coil winding body to the end of the motor terminal is shorter than the length from the coil winding body to the ends of the core blocks.

8. The mounting structure of claim 5, further comprising:

a shell;

support springs for supporting a main body frame inside the shell;

a terminal for supplying power to the linear compressor; and an electric wire for connecting the motor terminal to the terminal, wherein the end of the motor terminal is placed at a distance from the bottom of the shell, and the electric wire is taken out between the support springs and connected to the terminal.

* * * * *